US006152988A

United States Patent [19]

Plaks et al.

[11] Patent Number: 6,152,988

[45] Date of Patent: Nov. 28, 2000

[54] ENHANCEMENT OF ELECTROSTATIC PRECIPITATION WITH PRECHARGED PARTICLES AND ELECTROSTATIC FIELD AUGMENTED FABRIC FILTRATION

[75] Inventors: Norman Plaks, Raleigh; Charles B. Sedman, Hillsborough, both of N.C.

[73] Assignee: The United States of America as represented by the Administrator of the Environmental Protection Agency, Washington, D.C.

[21] Appl. No.: 09/176,251

[22] Filed: Oct. 21, 1998

Related U.S. Application Data

[60] Provisional application No. 60/062,614, Oct. 22, 1997.

[51] Int. Cl.[7] ..... B03C 3/155

[52] U.S. Cl. ..... 95/58; 55/341.1; 55/341.11; 55/DIG. 38; 95/70; 95/73; 96/55; 96/74; 96/77

[58] Field of Search ..... 96/55, 96, 27, 96/74, 77, 79; 95/58, 70, 73; 55/341.1, DIG. 38, 341.11

[56] References Cited

U.S. PATENT DOCUMENTS

| | | | |
|---|---|---|---|
| 1,185,135 | 5/1916 | Seaman | 95/73 X |
| 2,608,266 | 8/1952 | Wintermute | 55/DIG. 38 |
| 3,117,068 | 1/1964 | Morrow et al. | 55/DIG. 38 |
| 3,915,676 | 10/1975 | Reed et al. | 55/DIG. 38 |
| 5,024,681 | 6/1991 | Chang | 96/55 X |
| 5,059,219 | 10/1991 | Plaks et al. | 96/96 X |
| 5,158,580 | 10/1992 | Chang | 96/55 X |
| 5,217,511 | 6/1993 | Plaks et al. | 96/55 |
| 5,591,412 | 1/1997 | Jones et al. | 95/58 X |
| 5,938,818 | 8/1999 | Miller | 96/55 X |

FOREIGN PATENT DOCUMENTS

| | | | |
|---|---|---|---|
| 580909 | 11/1977 | U.S.S.R. | 96/96 |

*Primary Examiner*—Richard L. Chiesa
*Attorney, Agent, or Firm*—Lorusso & Loud

[57] ABSTRACT

An electrostatic bag filter unit is formed of a plurality of sections arranged in series. One section is a bag filter section containing a plurality of parallel elongated filter fabric bag elements extending across and traverse to a gas flow path therethrough and a plurality of grounded, electrically-conductive support frames, each support frame being internal to and supporting one of the filter fabric bag elements. Optionally, the bag filter section may further include a plurality of non-discharging electrodes disposed parallel to and interspersed among the filter fabric bag elements. A filter precharger section is located immediately upstream of and contiguous with the bag filter section and is formed of a linear array of alternating corona discharge electrodes and grounded electrodes arranged perpendicular to the gas flow path.

24 Claims, 7 Drawing Sheets

ENHANCEMENT OF ELECTROSTATIC PRECIPITATION WITH PRECHARGED PARTICLES AND ELECTROSTATIC FIELD AUGMENTED FABRIC FILTRATION

CROSS REFERENCE TO RELATED APPLICATION

This application claims priority, under 35 USC 119 (e), of provisional application serial No. 60/062,614 filed Oct. 22, 1997.

BACKGROUND OF THE INVENTION

Recent research findings have shown that fine, sub-micron particles suspended in the air cause a much greater negative health effect than had previously been suspected. This finding will very likely result in more stringent ambient air quality standards than the current PM-10 (particles less than 10 micrometers). The standard will likely be reduced to PM-2.5 or even PM-1. The state implementation plans that will develop in response to the more stringent Federal ambient air quality standards will require that many of the existing particulate control devices on coal-fired utility boilers and other industrial sources be upgraded to reduce their emission of the sub-micron fine particles.

Electrostatic precipitators are used as the particulate control device on about 90% of the coal-fired electric utility boilers and many major industrial plants. A large number of these electrostatic precipitators will require upgrading to meet the expected more stringent limits on emission of sub-micron fine particles.

U.S. Pat. No. 5,024,681 entitled "Compact Hybrid Particulate Collector" discloses a combination of an electrostatic precipitator and, downstream of the electrostatic precipitator and in series therewith, a fabric filter baghouse. U.S. Pat. No. 5,024,681 asserts an improvement in the performance of the "barrier filter" due to the residual charge on the particles exiting the electrostatic precipitator. However, particles exiting the electrostatic precipitator do not contain, because of various losses, the maximum electric charge. After traveling through the ductwork connecting the electrostatic precipitator to the downstream filtration unit, a good portion of the electric charge is lost from the particles. Further, this device incurs a significant gas-side pressure drop, an energy penalty typical of fabric filters and may require additional fans and space not readily available.

A "Compact Hybrid Particulate Collector" (COHPAC) is disclosed in U.S. Pat. No. 5,158,580, issued Oct. 27, 1992. In this device a conventional fabric filter replaces the last section of an electrostatic precipitator. Recent tests have indicated that this device introduces a higher than expected and desired pressure drop. The patent teaches that some of the particles that enter the array of bags have an electrical charge. As is well known to workers in the field of electrostatics, as many as half of the particles exiting from an electrostatic precipitator have been previously collected on the grounded collector plates from whence they have been reentrained back into the gas stream upon the cleaning or rapping of the plates. Upon being collected onto the grounded plates, their electrical charge is drained off, causing many of the particles exiting the electrostatic precipitator to be uncharged. The remaining particles have a relatively low level charge.

Our previous invention "Enhancement of Electrostatic Precipitation with Electrostatically Augmented fabric Filtration," U.S. Pat. No. 5,217,511, issued Jun. 8, 1993, taught that it is possible to have an electrostatic precipitator with conventional collector and electrode sections followed by an electrostatically enhanced fabric filtration section. That patent further teaches that the electrostatically enhanced filtration section increases the overall particulate collection beyond what would be possible by an electrostatic precipitator alone. The disclosed filtration unit has corona discharge electrodes interspersed among the filter bags to charge the incoming particulate matter. The electric field established between the corona discharge electrodes and the filter bags causes the charged particles to collect upon the filter bags non-uniformly.

The heaviest deposit of particles in the apparatus of our previous patent was upon the first bags in the direction of gas flow, and the lightest deposit upon those bags last in the direction of gas flow. U.S. Pat. No. 5,217,511 further teaches that the non-uniform deposit caused the overall pressure drop to be less than for a filtration section without electrostatic enhancement and, consequently, with a uniform deposit. One other aspect taught by U.S. Pat. No. 5,217,511 is the use of perforated gas diffusion plates placed before the electrostatic precipitator section to maintain good gas velocity distribution for the gas exiting the electrostatic precipitator sections.

However, in operation of the filtration apparatus disclosed in U.S. Pat. No. 5,217,511 it was found that if the electrical resistivity of both the particulate matter and the filter bags is excessively high the result is a condition well known in the art of electrostatic precipitation called back ionization or back corona. This is caused when the product of the current density (Amperes/cm$^2$) and the resistivity (ohm-cm) achieves an electric field of 5000–10,000 volts/cm. When this occurs the gas in the interstitial spaces of the particulate mater and the filter media ionizes and injects ions of opposite polarity into the gas space that disrupts the charging process and non-uniform collection mechanism. It was further found that when the corona discharge electrodes were energized with sufficient voltage to cause corona, that the likelihood of sparking between the corona discharge electrodes and the filter bags was increased. Excessive sparking tends to cause the formation of holes (=leaks) in the fabric of the filter bags. To overcome the likelihood of sparking it is necessary to maintain good alignment of the corona discharge electrodes and the filter bags, and good voltage control to maintain operation below the sparking limit, which measures both add expense to the system. Finally the diffusion plates add to the gas flow pressure drop, and consequently to power consumption and its cost, due to the greater force needed to cause the gas to flow through the system.

SUMMARY OF THE INVENTION

It has now been discovered that it is possible to overcome the foregoing difficulties by operating the electrodes of the bag filter unit in a non-corona current producing mode, with addition of a precharging unit immediately upstream of the bag filter unit.

More specifically, it has now been found that by placing maximum charge upon the particles by means of a precharger, and placing an electric field within the filterbag array by means of interspersed non-ionizing electrodes, improvement of performance over that of U.S. Pat. No. 5,024,681 is obtained. The improvement in performance is in reduced pressure drop that results from the non-uniform deposit and from decreased particle penetration through the filter media and less fabric wear as previously discussed. Without the electric field within the filterbag array, e.g. as in the apparatus disclosed by U.S. Pat. No. 5,024,681, there is no reduction in particle penetration of the filter media by the mechanism of their following the electric field lines rather than the gas streamlines.

The present invention develops the desired non-uniform deposit by imparting a high level of charge to the particulate matter prior to entering the array of bags containing the non-ionizing electrodes, using a separate precharger for the bag filter unit.

Accordingly, the present invention provides an electrostatic bag filter which includes a plurality of sections arranged in series within an elongated housing having a gas inlet at an upstream end and a gas outlet at a downstream end to define a gas flow path therebetween. At least one of the sections arranged in series within the housing is a bag filter unit which includes a plurality of parallel, elongated filter fabric bag elements extending across and transverse to the gas flow bath. The bag filter section includes a plurality of grounded, electrically-conductive support frames, each support frame being internal to and supporting one of the filter fabric bag elements. Optionally, also within the bag filter section are a plurality of non-discharging electrodes disposed parallel to and interspersed among the filter fabric bag elements. If the optional non-discharging electrodes are included, a power source is provided to impose a voltage between the support frames and the non-discharging electrodes to establish a voltage sufficient to form an electric field which causes charged particles in the gas flow to migrate toward and collect on the filter fabric bag elements, but insufficient to produce a corona discharge. A filter precharger section is located immediately upstream of and contiguous with the bag filter section and includes at least one linear array of alternating corona discharge electrodes and grounded electrodes arranged perpendicular to the gas flow path. A second (or first) power source serves to impose a voltage producing a corona discharge between the corona discharge electrodes and the grounded electrodes. The corona discharge in the filter precharger serves to impart a charge to particulates contained within the incoming gas flow. Particulates periodically discharged from the filter fabric bag elements are collected in a bottom portion of the bag filter section.

In a preferred embodiment the filter precharger includes a plurality of linear arrays of the alternating corona discharge electrodes and grounded electrodes, which arrays are staggered so that the majority of corona discharge electrodes in one linear array are aligned with the grounded electrodes of an adjacent linear array. Preferably the grounded electrodes have a diameter at least equal to the center-to-center distance between adjacent grounded electrodes in one of the linear arrays divided by the number of linear arrays, so that the grounded electrodes block line of sight between the gas inlet and the bag filter section parallel to the gas flow path.

In another preferred embodiment the apparatus of the present invention additionally includes conventional electrostatic charging/collecting plate sections upstream of the filter precharger.

In another aspect, the present invention provides a process for removing solid particulates from a gas flow stream using the above-described apparatus. In operation, the gas flow stream is passed through the filter precharger which is located upstream of the bag filter unit to impart a charge to the solid particulates. If non-discharging electrodes are employed in the bag filter unit, a voltage may be imposed between the support frames and the non-discharging electrodes which is sufficient to establish an electrical field causing the charged particles to travel toward and collect on the filter fabric bag elements but is insufficient to produce a corona between the support frames and the electrodes. On the other hand, the filter precharger is operated at a voltage sufficient to produce a corona discharge for the purpose of imparting a charge to the incoming solid particulates.

In the process of the present invention where a plurality of staggered arrays of corona discharge electrodes and grounded electrodes are employed within the filter precharger, to block line of sight between the bag filter unit and the gas inlet, those filter precharger electrodes also produce a turbulence in the entering gas flow stream and thereby serve to improve filtering efficiency.

The voltage employed between the support frame and the grounded electrodes within the bag filter unit will typically be 100–1000 volts below the minimum voltage producing a corona.

By using staggered arrays of electrodes in the filter precharger to block line of sight gas flow, the filter fabric bag elements within the bag filter unit are protected from direct impact by high velocity, larger particulates which might damage the filter fabric bag elements. In other words, the staggered arrays of electrodes within the filter precharger serve to break the momentum of the particles contained in the gas flow to minimize penetration of the filter fabric bag elements by the particulates and to minimize fabric wear. Given a line of sight flow path, the particulates would severely wear the fabric of the bag filter elements in the manner of a sand blast, and would also increase particle emissions due to higher momentum particles actually penetrating the fabric. This is particularly true wherein the bag filter unit and the filter precharger are operated as a stand alone unit, i.e. without additional, conventional electrostatic charging/collecting sections upstream of the filter precharger, which would effectively remove the larger particles of concern.

It is necessary to operate the corona discharge electrodes of the filter precharger at an electrical operating voltage above that which is known to workers in the art of electrostatic precipitation as the corona onset voltage. The corona onset voltage is that voltage at which the gas immediately adjacent to the corona discharge electrode starts to ionize because of the very high electric field formed at the curved surface, which then transfers the charge to the particles. The corona onset voltage is a function of the gas temperature and density, corona discharge electrode diameter, its distance from the bags, and the surface roughness of the electrode. The corona onset voltage for an electrode increases with its diameter and distance from the bags, and decreases with the surface roughness.

Thus, the present invention offers the advantage of a reduced pressure drop in a filtration system due to the non-uniform deposit of the particles that results from the dominance of the electrostatic precipitation effect over that of the conventional filtration effect. It is further noted that along with the above pressure drop reduction effect there is reduced penetration or leakage of particles through the filter media. This is due to the electric field lines terminating upon the filter media. The charged particles tend to follow the electric field lines that terminate upon the filter media, where they collect, rather than the gas streamlines, as they pass through pores and other paths through the filter media. The decreased particle penetration through the filter media results in an overall increase in particle collection efficiency and decrease in wear of the filter fabric.

It has also been learned that by placing the precharger just upstream of the filter bags the charge level on the particles is not only restored, but even made stronger than the maximum residual charge that can be on particles exiting the electrostatic precipitator. It has been further learned that the greater is the charge, the more porous is the collected particulate layer. This causes the operation of the unit with a precharger means upstream of the collecting filter bags to provide a lower pressure drop than is provided by the technology taught by U.S. Pat. No. 5,024,681, which latter technology depends upon residual charge on the particles that remain after they exit from the electrostatic precipitator located upstream of it.

DESCRIPTION OF THE PREFERRED EMBODIMENTS

Figure 1:
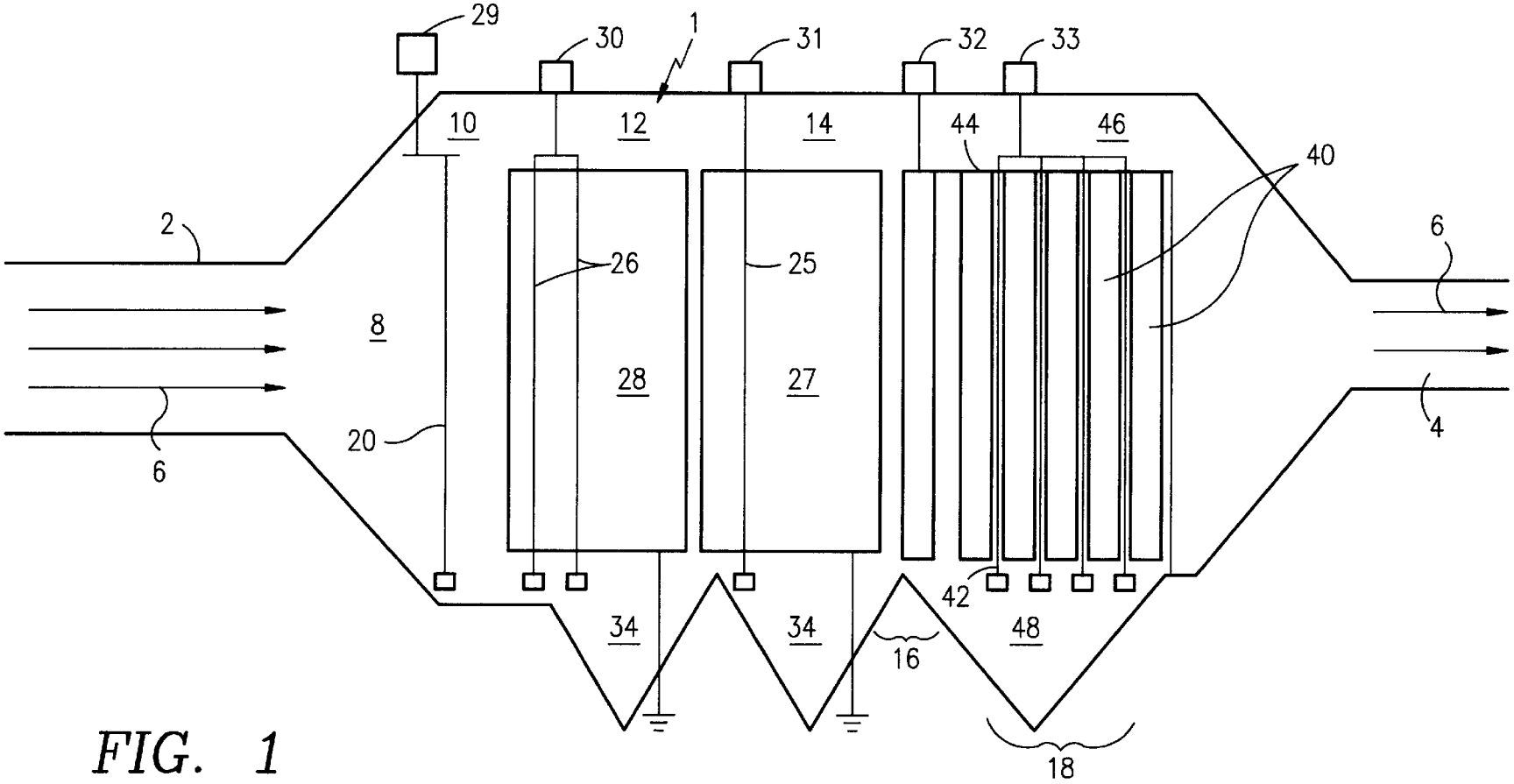
FIG. 1 is a schematic illustration of a first embodiment of the apparatus of the present invention.

FIG. 1 shows an electrostatic precipitator (hereinafter "ESP") as including a housing 1 extending between a gas inlet 2 and a gas outlet 4. The housing 1 contains a plurality of serially arranged units including a precharger unit 10, collecting units 12 and 14, a filter precharger unit 16 and a bag filter unit 18. The precharger unit 10 includes a plurality of corona discharge wires 20 powered by a high voltage direct current energy source 29 and alternating with grounded electrodes (not shown) in a linear array transverse to the gas flow path indicated by arrows 6 in the drawing. The precharger section 10 and the collector sections 12 and 14 are conventional in the art and are as described in U.S. Pat. No. 5,059,219 issued to Plaks et al Oct. 22, 1991 and entitled "Electroprecipitator with Alternating Charging and Short Collector Sections," the teachings of which are incorporated herein by reference. Briefly, the first collector section 12 includes corona discharge electrodes 26 arranged between collector plates 28. The collector plates 28 are arranged parallel to the gas flow 6 in a spaced array transverse to and spanning the gas flow 6. In like fashion, the second collector section 14 includes corona discharge electrodes 25 arranged between collector plates 27.

The transition section 8 provides a gas flow having a uniform velocity distribution to the electrostatic precipitator collection sections, 12 and 14. The collector sections 12 and 14 use conventional electrostatic precipitator collector means in which the incoming particles are electrically charged by corona discharge electrodes, energized by high voltage direct current sources 30, 31, and then are caused to be collected onto the collector plates under the influence of an electric field established between the corona discharge electrodes and the grounded collector plates. The electrostatic precipitator art is well established and known to workers in the field. These electrostatic precipitator sections can be either a single-stage in which particle charging and collection occur simultaneously, or a two-stage device as shown in which the charging and collection functions are separated and performed consecutively. The collected particulate matter is mechanically removed from the grounded collector plates and allowed to fall into the hoppers 4, from where it is periodically removed. The majority of the particulate matter entering with the gas stream is removed by the electrostatic precipitator sections 12 and 14. After exiting from the electrostatic precipitator sections 12 and 14 the gas flow enters the filter precharging section 16, where the particles are imparted with a high level of electrical charge by corona discharge. Upon exiting the particle charging device 16 the gas flows into an array of filter bags 40, arranged perpendicular to the gas flow. Interspersed among the filter bags are electrodes energized by a high voltage direct current source 33. The high voltage source 33 is used to establish an electrical field between the electrodes and the filter bags, and to cause the deposition of a non-uniform dust layer on the exterior surfaces of the filter bags 40. The filter bags 40 are suspended from a tube sheet 44 which forms a plenum 46, into which the now cleaned gas flows from the filter bags 40. The gas exits the plenum 46 through the exit duct 4. From time-to-time the filter bags are cleaned by injecting a pulse or jet of high-pressure air down into the bags, making use of conventional techniques well known to workers in the art. The collected dust, which has been dislodged by the pulse jet falls into the hopper 48, from which it is periodically removed.

Figure 2:
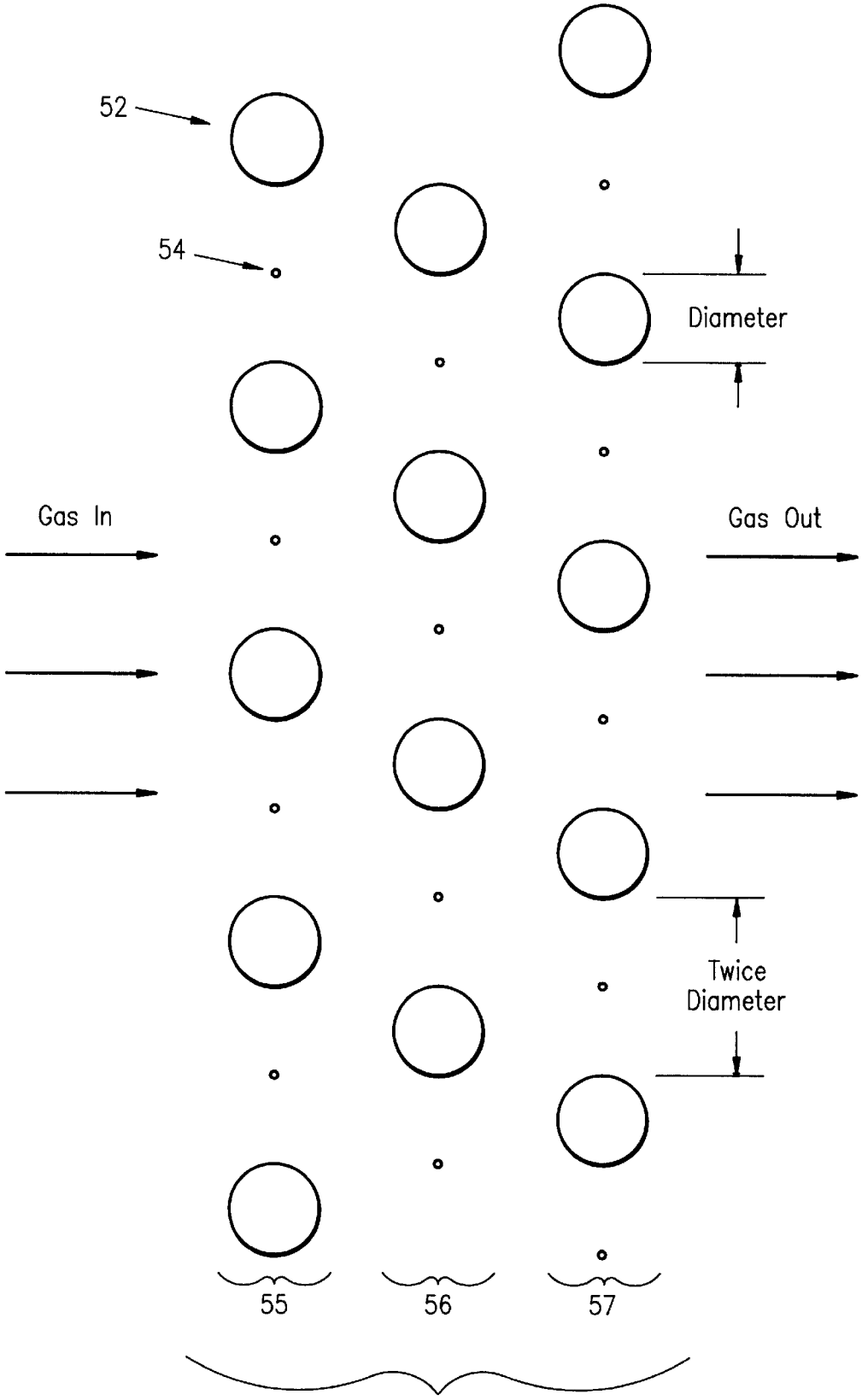
FIG. 2 is a schematic illustration of a filter precharger which may be used in any of the apparatus embodiments disclosed herein.

FIG. 2 is a plan view of a preferred embodiment of the charging section 16. Shown are 3 linear arrays 55, 56 and 57 of grounded pipes 52, perpendicular to the gas flow. Midway between adjacent electrodes in each array are corona electrodes 54 located on the same centerline. Each corona discharge electrode 54 is connected to a power source 32 of high voltage direct current sufficient to cause the formation of a corona discharge. The ions formed by the corona discharge, in turn, charge the particulate matter passing between the pipes. As in all other electrostatic precipitator devices, the grounded members which complete the circuit from the corona discharge electrode (here water-cooled pipes 52) serve as collectors for some of the particulate matter. If the particulate matter has a sufficiently high electrical resistivity, back ionization or corona will occur due to ionization of the gas in the interstitial spaces between the particles. This back ionization or corona is disruptive of the charging process. To prevent the formation of back corona, cooling water is caused to flow through the pipes 52, which in turn lowers the temperature, and consequently the resistivity of the particulate matter collected upon the surface. The charging pipe and corona discharge electrode array extends across the height and width of the electrostatic precipitator.

As further shown in FIG. 2, the three linear arrays of pipes 52 and electrodes 54 are staggered so that the particle bearing gas exiting one array enters the next to acquire additional electrical charge. FIG. 2 shows the pipes 52 and corona discharge electrodes 54 in which each array is offset so that the centerline of the pipes and electrodes correspond with the centerlines of the pipe and electrodes of the prior array. It has been learned that offsetting the arrays, especially when three or more arrays are used, will serve many of the same purposes served by the diffusion baffles of U.S. Pat.

Figure 8:
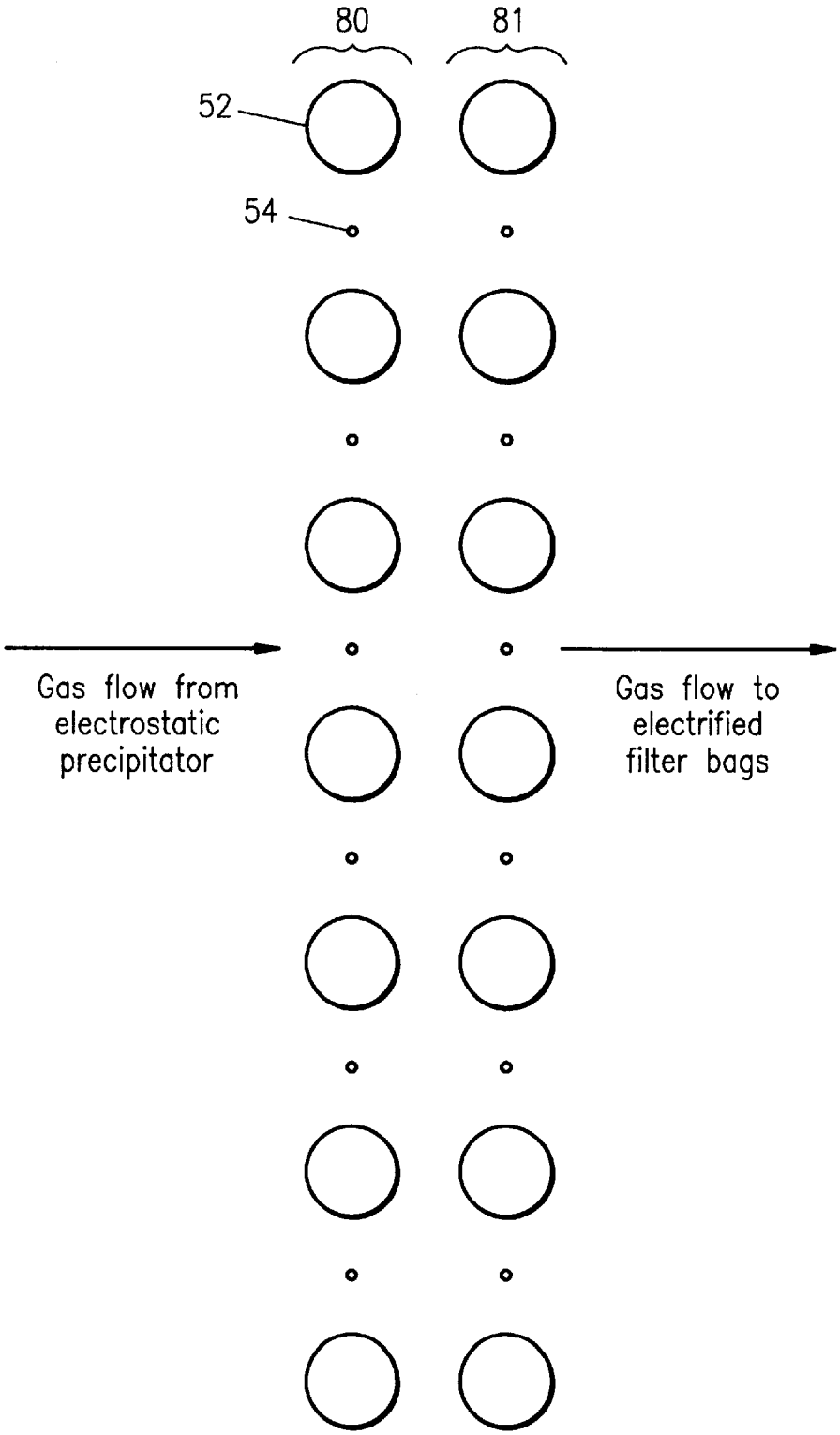
FIG. 8 is a schematic illustration of an alternative embodiment of a filter precharger.

No. 5,059,219 previously discussed. If desired for the very best flow distribution, diffusion baffles can be placed between the filter charging section and the filter bag array. While FIG. 2 represents a preferred arrangement for the filter precharger, in the alternative the linear arrays may be aligned, rather than staggered, as exemplified by linear arrays 80, 81 in FIG. 8.

Figure 3:
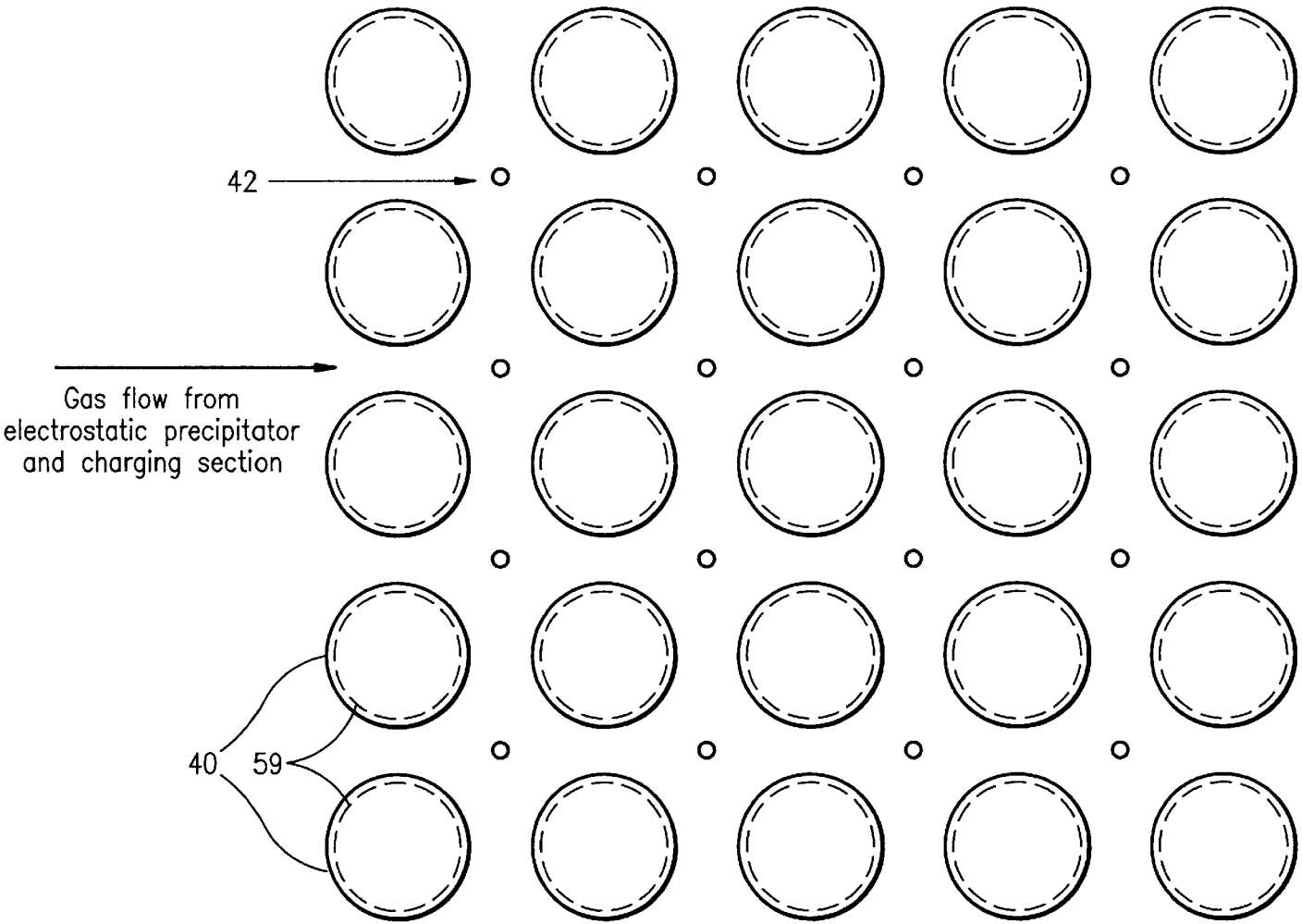
FIG. 3 is a schematic illustration of a bag filter section which may be employed in any of the apparatus embodiments disclosed herein.

FIG. 3 depicts a five by five array of filter bags 40. The array of filter bags would normally be installed across the complete width of the electrostatic precipitator housing. The depth or number of filter bags 40 to be used will be that sufficient to adequately handle the total gas flow. The gas carrying the residual particles from the electrostatic precipitator sections 12 and 14 passes through the filter charging section 16 and then enters the array of filter bags 40. All of the gas entering the filter bag array passes through the filter fabric from outside-to-inside, depositing its particulate matter upon the exterior surface. To prevent collapse of the filter bags 40, resulting from the outside-to-inside flow, each bag 40 contains an anti-collapse cage or frame 59 inside of it. The gas exits the top of the bags into the plenum 40 (see FIG. 1) and out through the exit duct 4. Centrally located between each group of four filter bags 40 is an electrode 42 connected to the negative polarity source 33 of high voltage direct current. To complete the circuit the filter bags and the internal cages are connected to ground, thus providing an electric field between the electrodes 42 and the filter bag cages 59. The voltage applied to the electrodes 42 is kept at a point just below corona onset to avoid corona and/or spark discharge which would injure bags 40. Bags 40 and their support frames or cages 59 are shown in more detail in Plaks et al U.S. Pat. No. 5,217,511, entitled "Enhancement of Electrostatic Precipitation with Electrostatically Augmented fabric Filtration," the teachings of which are incorporated herein by reference.

The charged particles entering the array of filter bags 40 are collected upon the exterior surfaces of the filter bags 40 by a combination of electrostatic precipitation and the viscous flow of the gas through the filter media. Of the two, the electrostatic precipitation effect is by far the more dominant. The majority of the particles are collected upon the filter bags 40 close to the inlet of the array; less are collected upon the filter bags 40 further from the inlet of the array. Because the resistance to flow through the filter media increases with the amount of particulate matter collected on the surface, the majority of the gas flow is through the filter bags furthest from the inlet. The resistance to gas flow for this non-uniform particulate matter deposit is less than the same amount of material that would be deposited uniformly in a filter bag array without electrification.

Recently a highly capable and efficient computer software has been developed that models electrostatic precipitators very effectively. The latest version of the software is ESPVI 4.0a, which is in the public domain and is available from the National Technical Information Service of the Department of Commerce.

The linear array of pipes 52 and corona discharge electrodes 54 will normally have the pipes the same distance apart as are the collecting plates 28 in the conventional electrostatic precipitator section preceding it. The diameter of the pipes 52 is typically about 2.4 inches in diameter. The diameter of the corona discharge electrode has a typical diameter of ⅛ inch. At a temperature of 300° F., the negative high voltage applied to the corona discharge electrode is about 43–45 kv, and the current density is about 100 nA/cm$^2$. For cascaded linear array charging sections, the spacing between pipe sections should be at least equal to the center to center distance from the corona discharge electrode to the pipe. For the offset cascaded precharger sections the minimum recommended distance between sections is about 1.5 times the center to center distance of the corona discharge electrode to the pipe section. The grounded electrodes 52 are preferably water-cooled pipes having a diameter at least equal to the center-to-center distance between adjacent grounded electrodes 52 divided by the number of linear staggered arrays, whereby these grounded electrodes block line of sight gas flow paths between the gas inlet 2 and the bag filter section 18. To accurately determine the electrical conditions of the charging sections for different size pipes, electrodes and spacing, the aforementioned computer performance prediction software ESPVI 4.0a can be used.

To set the size of the power source (transformer/rectifier set) the following guidelines are offered for standard size filter bags of 4, 5, and 6 inch diameter. The centrally located electrode will have a conventional 0.125 inch diameter. The temperature is 300° F., which is typical for coal-fired electric utility operation.

| Filter bag diameter, In. | Distance between filter bags in row perpendicular to gas flow, In. | Voltage, kV of electrodes 42 |
|---|---|---|
| 4 | 2 | 22.0 |
| " | 1.5 | 21.0 |
| " | 1 | 19.0 |
| 5 | 2 | 22.7 |
| " | 1.5 | 21.7 |
| " | 1 | 20.6 |
| 6 | 2 | 23.2 |
| " | 2.3 | 22.3 |
| " | 1 | 21.3 |

The above voltages are provided only as guidelines. The corona onset voltage will decrease with increasing temperature, increase with decreasing temperature, and increase and decrease, respectively, with increasing and decreasing electrode diameter. Further, there will be a decrease in corona onset voltage with increasing surface roughness of the electrode. The above data also assumes good alignment of the electrodes in respect to the filter bags; misalignment will decrease the corona onset voltage. In actual practice the above voltages will be considered as nominal. The transformer/rectifier set will be chosen to provide a voltage in excess of the above voltages and, once installed, the voltage will be manually set by the operator to a point a small amount less than the actual corona onset voltage.

The depth or number of filter bag rows in the direction of flow is dependent upon the type of operation desired. The less filter bags that are used, the more gas pass through each filter bag. A range of operation would be 8 to 16 ft$^3$ per minute for each ft$^2$ of filter bag area. Workers in the field of fabric filtration are well versed in making these design calculations.

The performance of the system is in terms of the ratio of pressure drop across the electrified filter bags as compared to the pressure drop across non-electrified filter bags. The pressure drop reduction would range from 65 to 90%. The pressure drop reduction will vary with a number of factors. It will increase with the amount of gas flowing through the bags. It will decrease with increasing electrostatic precipitator size and number of charging sections.

Figure 4:
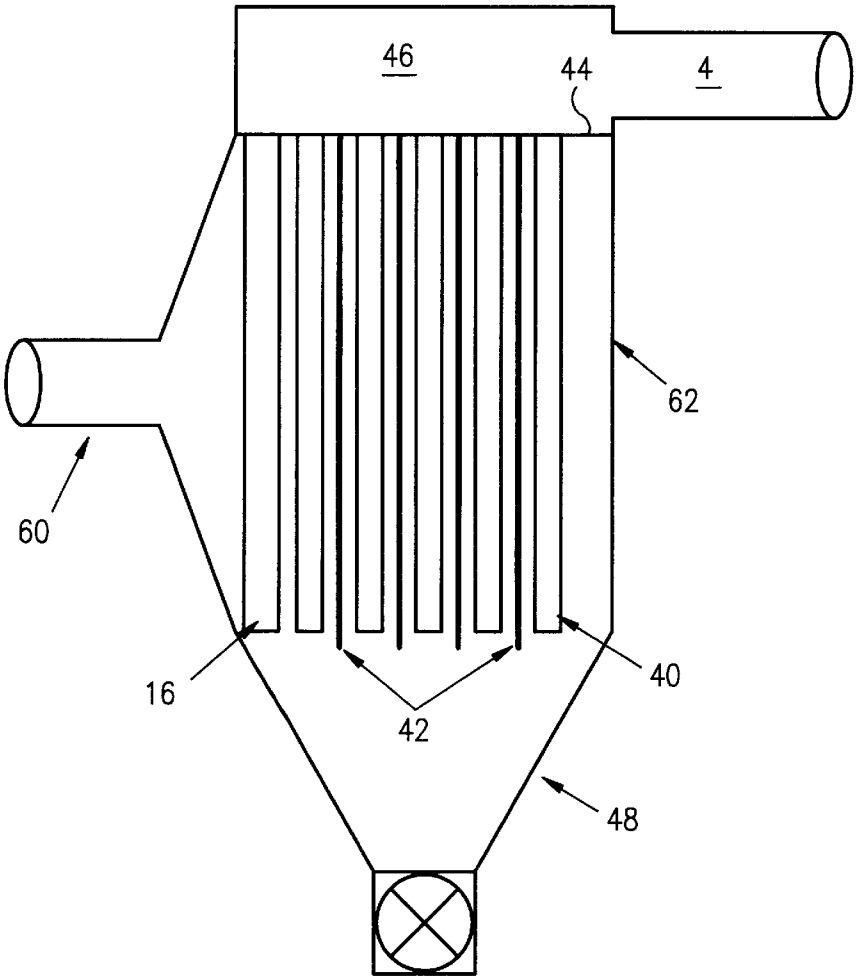
FIG. 4 is a schematic illustration of another embodiment of a bag filter unit.

As shown in FIG. 4, the array of fabric filter bags, with interspersed non-ionizing electrodes and precharger as in embodiment 1, can alternatively be placed within its own housing downstream of an electrostatic precipitator. This arrangement, downstream of the electrostatic precipitator, is otherwise similar to the unit shown in FIG. 1 as an add-on to a conventional, multi-stage electrostatic precipitator. Except for the non-ionizing electrodes and precharger, the arrangement within the filter bag housing and structural components are similar to the arrangement and structural components disclosed in U.S. Pat. No. 5,024,681, the teachings of which are incorporated herein by reference. It has been found that this arrangement of an array of fabric filtration bags with interspersed non-ionizing electrodes and precharger provides improved performance over the technology taught by U.S. Pat. No. 5,024,681 which is effective only to the extent that there is a residual charge on the particles exiting the electrostatic precipitator. However, in operation of the apparatus of U.S. Pat. No. 5,024,681, the particles exiting the electrostatic precipitator do not contain, because of various losses, the maximum electric charge. Further, after traveling through the duct work connecting the electrostatic precipitator to the downstream filtration unit, more of the electric charge is lost from the particles.

FIG. 4 shows a side entry filter bag housing 62 in which the particle bearing gas enters in a direction perpendicular to the bags 40. The filter bag unit of FIG. 4 may be operated as a stand alone unit or may be connected to the electrostatic precipitator sections of FIG. 1 by means of the duct 60. The electrostatic precipitator of FIG. 1, in turn, may then be operated with a conventional final section. The electrostatically enhanced bags 40 and high voltage non-ionizing electrode wires 42 are mounted within the filter bag housing 62. The filter bags and non-ionizing electrodes 42 are arranged in a manner similar to that of FIGS. 1 and 3, i.e. the bags 40 are suspended from the tube sheet 44 which defines a plenum 46 to allow the cleaned gas to exit through the outlet duct 4. In the side entry filter bag housing of FIG. 4 the precharger array 20 is suspended in the path of the inlet gas stream to charge the particles that are contained in the gas flow.

The filter bags are cleaned of the collected particles in the conventional manner by means of a periodically applied high pressure air jet which dislodges them. This causes the collected dislodged particles to fall into the hopper 48, from where they are removed from time-to-time. In the bottom entry filter bag housing arrangement (FIG. 5) the dislodged particles must fall through the openings in the precharger array.

The electrical energization of the precharger and electrodes in this embodiment is performed in a manner similar to the manner in which it is done when the assembly replaces the final section of an electrostatic precipitator as in FIG. 1. Further, as in the embodiment of FIG. 1, separate high voltage energization units are used for the precharger and non-ionizing electrodes and the setting of the voltages is performed in a similar manner.

Figure 5:
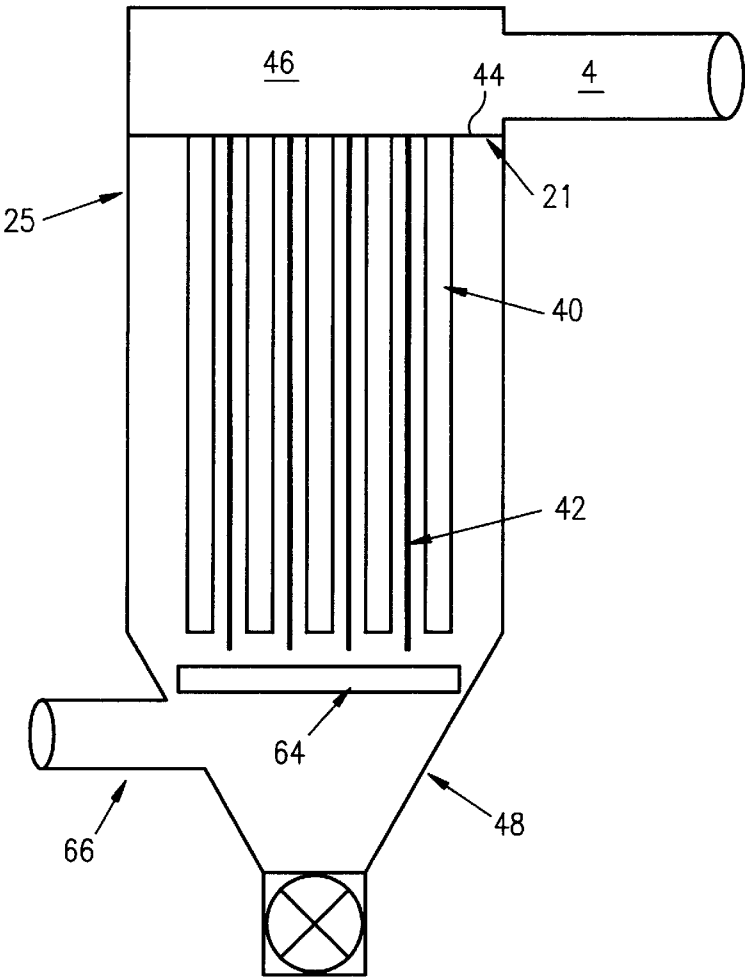
FIG. 5 is a schematic illustration of yet another embodiment of a bag filter unit.

FIG. 5 shows a bottom entry filter bag housing in which the particle bearing gas, after entering, flows in a direction parallel to the bags 40. In the bottom entry filter bag housing of FIG. 5, the precharger array 16 is suspended in the gas flow path beneath the filter bags.

In yet another embodiment a solid sorbent is injected. The increased charge on the particles and more porous particle layer provides the opportunity for superior gas sorption by the addition of a solid sorbent, such as activated carbon for mercury vapor or volatile organic compounds, or a solid alkali such as a sodium or calcium compound for acid gases. The solid sorbent or alkali is injected upstream of the precharger. When the fabric filter is acting as a fixed-bed gas absorber by virtue of injection of a sorbent, it is desirable to have as much gas solid contact as possible and, therefore, the period between filter bag cleaning is usually longer. Additionally, it has been found that the non-uniform particle deposit of the previous embodiments is less suitable for sorbent injection because the majority of the gas goes through the region in which the particulate layer is thinnest. The longer time between filter bag cleanings would normally lead to increased pressure drop which, however, is compensated for by the high level of charge placed upon both the particles and the injected solid sorbent. The now thicker porous layer of combined particulate matter and solid sorbent causes a longer residence time for the gas in passing through it than does a less porous layer. This, in turn, results in more efficient pollutant sorption from the gas because of the longer reaction time in the collected particulate layer.

The embodiments of FIGS. 4 and 5 can be operated without the nonionizing electrodes installed, and with or without sorbent injection. Therefore for the case in which some level of pressure drop reduction is desired, as with sorbent injection, the apparatus of FIGS. 4 and 5 can be operated with the non-ionizing electrodes unenergized, or can be modified by construction without the non-ionizing electrodes installed. Likewise, the embodiment of FIG. 1 can be modified by omission of non-ionizing electrodes 42.

One of the inherent problems encountered in those embodiments without upstream ESP is that the larger particles are not preferentially scavenged and are not prevented from impinging upon the filter media. The effects of their impingement are twofold. First, with certain types of filter media, the particles could acquire sufficient kinetic energy to actually penetrate the material and consequently repollute the cleaned gas. A second problem, especially with more abrasive particles, is erosion of the filter medium, which can significantly shorten its useful operating life. It has been found that it is possible to use the precharger array to intercept the particles thereby preventing them from directly impinging upon the filter media. It has been further found that taking measures to minimize direct impingement of the particles upon the filter media simultaneously improves the diffusion baffling capability of the precharger array. The filter bag configuration that is most troubled by particle penetration and erosion of the filter media is the one in which the particle bearing gas approaches perpendicular to the filter bags as in the embodiment of FIG. 1, wherein filter bags replace the last section of an electrostatic precipitator, and in the embodiment of the side entry filter bag housing shown in FIG. 4. The bottom entry filter bag housing (FIG. 5), in which the particle bearing gases approach parallel to the filter bags, is less sensitive to the aforementioned effects. In addition, the need for diffusion baffles to improve flow distribution is most acute for the embodiments of FIGS. 1 and 4.

In general, the approach to preventing direct impingement of particles upon the filter media is to take measures to assure that for the entering particles that there isn't a direct line-of-sight path to the filter media. To increase the diffusion baffle effect there should be as many changes in direction as possible for the particle carrying gas flow.

One means for preventing such direct impingement is to use an electrode arrangement as shown in FIG. 2. Shown there are three precharger rows in which the center-to-center distance between pipes 13 in each row is three times the pipe diameter. Each row is offset from the adjacent row by the diameter of the pipes. By this means there is not-a direct line of-sight path through the array for particles entering perpendicular to the precharger. In addition, to pass through the array, the particle bearing gas stream has to make several turns.

Figure 6:
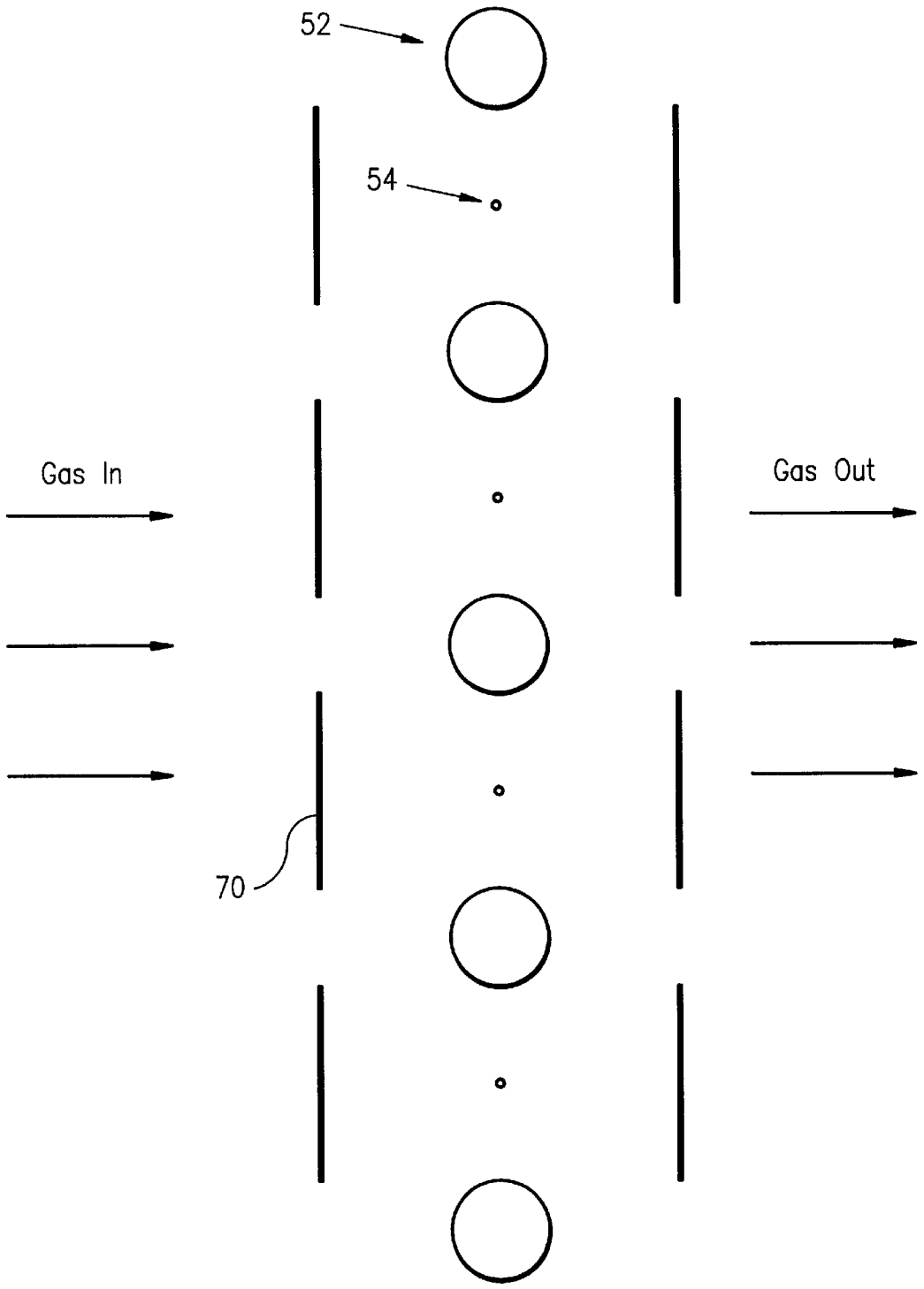
FIG. 6 is a schematic illustration of another embodiment of a filter precharger section.

Another arrangement for preventing such direct impingement is shown in FIG. 6 in which metal shields 70 are placed in line with the openings between pipes 52 in a single row precharger array. The width of the metal shields is equal to or a small amount greater than the opening between the pipes. This arrangement again causes the gas stream to make several turns and prevents a direct line-of-sight particle penetration for particles approaching perpendicular to the array. For proper operation of the precharger it is important to make certain that none of the electric field lines from the corona discharge electrode terminate upon the metal shield plates. This is done by putting a voltage upon the plates 70 equal in magnitude and polarity to the voltage on the precharger corona discharge electrodes 54. As a result, no particulates adhere to the plates 70 due to electrostatic forces.

Figure 7:
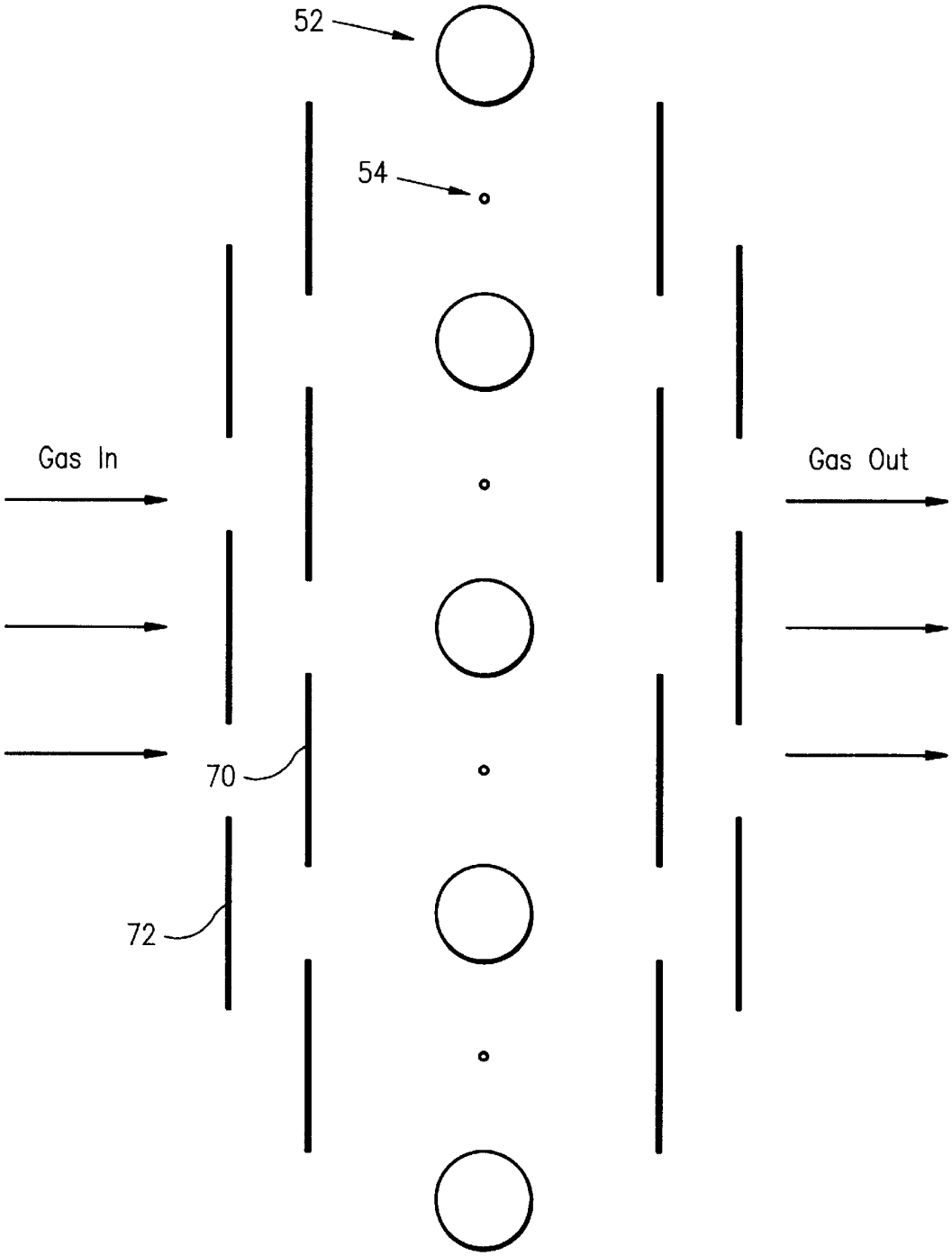
FIG. 7 is a schematic illustration of yet another embodiment of a filter precharger section.

Yet another, and even more effective, diffusion baffling example is shown in FIG. 7. A double set of metal shields includes an outer set of shields 72 which cover the openings between the inner set of metal shields 70, thereby introducing additional changes in direction for the gas stream. For best electrical operation the shielding plates should be at the same voltage as are the corona discharge electrodes 54.

It should be noted that as additional gas stream turns are added to increase the diffusion baffling effect the pressure drop across the precharger array increases. A balance must be struck between the amount of diffusion baffling desired and the increased pressure drop. Optimizing gas flow, such as is needed for setting up the shielded precharger array is an important aspect of electrostatic precipitator operation that is well known in the art.

A precharger plus non-ionizing electrodes, or a precharger by itself, may be added to an existing fabric filter bag housing assembly. The preexisting unit might be of the basic side type of FIG. 4 or the bottom entry type of FIG. 5. For the side entry type it was determined that the room for placement of the precharger array can most usually be made available by removing one row of filter bags, which, in turn, will provide the space for the precharger 16. It has been further learned that the loss in filtration ability caused by removal of the one row of filter bags is more than made up for by the inclusion of the precharger plus nonionizing electrodes or of precharger by itself. For the bottom entry filter bag housing of FIG. 5 room for the precharger array can invariably be made by shortening the length of the filter bags somewhat. The loss in filtration ability caused by shortening of the filter bags is more than made up for by the inclusion of the precharger plus non-ionizing electrodes or of precharger by itself.

The advantages of this invention are:

1. This electrostatic filtration system is relatively insensitive to particulate matter having a high resistivity. This becomes especially important in applications such as coal-fired electric utility boilers in switching from low sulfur to high sulfur coal. Resistivity increases with decreasing sulfur content.
2. The electrified filter bag array is operated at voltages below onset of corona current, thereby making them less sensitive to sparking due to back corona. When there is sparking between the corona discharge electrode and the filter bags, punctures are likely to occur.
3. The use of the separate charging system allows the diffusion baffle following the electrostatic precipitator section to be eliminated.
4. The operation of the filter bags below the corona onset eliminates the possibility of back ionization or corona, which in turn would result in higher currents, injection of opposite charged particles into the gas stream, and decreased collection of particles.
5. The cascading of filter precharger arrays increases the level of charge upon the particles.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

We claim:

1. An electrostatic bag filter formed of a plurality of sections arranged in series in an elongated housing having a gas inlet at an upstream end and a gas outlet at a downstream end and defining a gas flow path for gas flow therebetween, said sections comprising:

a bag filter section comprising:

a plurality of parallel, elongated filter fabric bag elements extending across and transverse to the gas flow path;

a plurality of grounded electrically-conductive support frames, each support frame being internal to and supporting one of said filter fabric bag elements;

a plurality of non-discharging electrodes disposed parallel to and interspersed among said filter fabric bag elements; and first power means for imposing a first voltage between said support frames and said non-discharging electrodes, said first voltage being sufficient to establish an electrical field causing charged particles in the gas flow to migrate toward and collect on said filter fabric bag elements, but insufficient to produce a corona discharge;

a filter precharger section located immediately upstream of and contiguous with said bag filter section, said filter precharger section comprising:

at least one linear array of alternating corona discharge electrodes and grounded electrodes arranged perpendicular to said gas flow path; and second power means for imposing a second voltage, producing a corona discharge, between said corona discharge electrodes and said grounded electrodes, the corona serving to impart a charge to particulates contained in the incoming gas flow; and first particulate collection means for collecting separated particulates, dislodged from said filter fabric bag elements.

2. An electrostatic bag filter according to claim 1 comprising a plurality of said linear arrays which are staggered so that the majority of corona discharge electrodes of one linear array are aligned with the grounded electrodes of an adjacent linear array.

3. An electrostatic bag filter according to claim 2 wherein said grounded electrodes have a diameter at least equal to the center-to-center distance between adjacent grounded electrodes in one of said linear arrays divided by the number of linear arrays in said plurality of linear arrays, whereby said grounded electrodes block a line of sight between said gas inlet and said bag filter section, said line of sight being parallel to said gas flow path.

4. An electrostatic bag filter according to claim 1 wherein said sections additionally comprise:

a plurality of collector sections upstream of said filter precharger section, each of said collector sections comprising a plurality of parallel collection plates, said collection plates being evenly spaced to define a plurality of gas flow lanes therebetween, and second particulate collection means for collecting electroprecipitated particles from the bottom of each of said collector sections.

5. An electrostatic bag filter according to claim 1 wherein said grounded electrodes are hollow cooled pipes.

6. An electrostatic bag filter according to claim 1 wherein said grounded electrodes are flat plates.

7. A process for removing solid particlates from a gas flow stream comprising:

providing a bag filter unit including a housing defining a gas flow path between a gas inlet and a gas outlet and, mounted within said housing, a plurality of parallel, elongated filter fabric bag elements extending across and transverse to the gas flow path, a plurality of non-ionizing electrodes, and a plurality of grounded, and electrically-conductive support frames, each frame being internal to and supporting one of said filter fabric bag elements;

passing said gas flow stream through a filter precharger upstream of the bag filter unit to impart a charge to said particulates;

imposing a voltage between said support frames and said non-ionizing electrodes sufficient to establish an electrical field causing the charged particulates to travel toward and collect on said filter fabric bag elements but insufficient to produce a corona between said support frames and said electrodes; and collecting the charged particulates which travel toward and collect on said filter fabric bag elements.

8. A process according to claim 7 wherein said voltage is 100–1000 volts below a minimum voltage for producing said corona.

9. A process according to claim 7 further comprising producing turbulence in the gas flow stream entering the bag filter unit by using, as the precharger, plural rows, transverse to the gas flow path, of alternating corona discharge electrodes and grounded electrodes, with the plural rows being staggered to block lines of sight, parallel to the gas flow path, between the gas inlet and the bag filter unit.

10. A process according to claim 7 further comprising injecting a solid sorbent into the gas flow stream upstream of the filter precharger.

11. A process according to claim 7 wherein said voltage is at or below a minimum voltage for producing corona.

12. A process according to claim 7 wherein the filter precharger includes a plurality of grounded electrodes in the form of hollow pipes and wherein the process further comprises circulating a coolant through the hollow pipes.

13. An electrostatic bag filter formed of a plurality of sections arranged in series in an elongated housing having a gas inlet at an upstream end and a gas outlet at a downstream end and defining a gas flow path for gas flow therebetween, said sections comprising:

a bag filter section comprising:

a plurality of parallel, elongated filter fabric bag elements extending across and transverse to the gas flow path; and a plurality of grounded electrically-conductive support frames, each support frame being internal to and supporting one of said filter fabric bag elements;

a filter precharger section located immediately upstream of and contiguous with said bag filter section, said filter precharger section comprising:

a plurality of linear arrays of alternating corona discharge electrodes and grounded electrodes arranged perpendicular to said gas flow path, wherein said linear arrays are staggered so that the majority of corona discharge electrodes of one linear array are aligned with the grounded electrodes of an adjacent linear array; and first power means for imposing a first voltage, producing a corona discharge, between said corona discharge electrodes and said grounded electrodes, the corona serving to impart a charge to particulates contained in the incoming gas flow; and particulate collection means for collecting separated particulates, dislodged from said filter fabric bag elements.

14. An electrostatic bag filter according to claim 13 wherein said bag filter section further comprises:

a plurality of non-discharging electrodes disposed parallel to and interspersed among said filter fabric bag elements; and second power means for imposing a second voltage between said support frames and said non-discharging electrodes, said second voltage being sufficient to establish an electrical field causing charged particles in the gas flow to migrate toward and collect on said filter fabric bag elements, but insufficient to produce a corona discharge.

15. An electrostatic bag filter according to claim 13 wherein said grounded electrodes have a diameter at least equal to the center-to-center distance between adjacent grounded electrodes in one of said linear arrays divided by the number of linear arrays in said plurality of linear arrays, whereby said grounded electrodes block a line of sight between said gas inlet and said bag filter section, said line of sight being parallel to said gas flow path.

16. An electrostatic bag filter according to claim 13 wherein said sections additionally comprise:

a plurality of collector sections upstream of said filter precharger section, each of said collector sections comprising a plurality of parallel collection plates, said collection plates being evenly spaced to define a plurality of gas flow lanes therebetween, and second particulate collection means for collecting electroprecipitated particles from the bottom of each of said collector sections.

17. An electrostatic bag filter according to claim 13 wherein said grounded electrodes are hollow cooled pipes.

18. An electrostatic bag filter according to claim 13 wherein said grounded electrodes are flat plates.

19. A process for removing solid particulates from a gas flow stream comprising:

providing a bag filter unit including a housing defining a gas flow path between a gas inlet and a gas outlet and, mounted within said housing, a plurality of parallel, elongated filter fabric bag elements extending across and transverse to the gas flow path and a plurality of grounded; and electrically-conductive support frames, each frame being internal to and supporting one of said filter fabric bag elements;

passing said gas flow stream through a filter precharger upstream of the bag filter unit to impart a charge to said particulates; and producing turbulence in the gas flow stream entering the bag filter unit by using, as the precharger, plural rows, transverse to the gas flow path, of alternating corona discharge electrodes and grounded electrodes, with the plural rows being staggered to block lines of sight, parallel to the gas flow path, between the gas inlet and the bag filter unit; and collecting the charged particulates which travel toward and collect on said filter fabric bag elements.

20. A process according to claim 19 further comprising injecting a solid sorbent into the gas flow stream upstream of the filter precharger.

21. A process according to claim 19 wherein the bag filter unit further includes a plurality of non-ionizing electrodes, said process further comprising;

imposing a voltage between said support frames and said non-ionizing electrodes sufficient to establish an electrical field causing the charged particulates to travel toward and collect on said filter fabric bag elements but insufficient to produce a corona between said support frames and said electrodes.

22. A process according to claim 21 wherein said voltage is 100–1000 volts below a minimum voltage for producing said corona.

23. A process according to claim 21 wherein said voltage is at or below a minimum voltage for producing corona.

24. A process according to claim 19 wherein the filter precharger includes a plurality of grounded electrodes in the form of hollow pipes and wherein the process further comprises circulating a coolant through the hollow pipes.

* * * * *